US006176840B1

(12) United States Patent
Nishimura et al.

(10) Patent No.: US 6,176,840 B1
(45) Date of Patent: Jan. 23, 2001

(54) ULTRASONIC COSMETIC TREATMENT DEVICE

(75) Inventors: Shinji Nishimura; Masayuki Hayashi, both of Kadoma (JP)

(73) Assignee: Matsushita Electric Works, Ltd., Osaka-fu (JP)

( * ) Notice: Under 35 U.S.C. 154(b), the term of this patent shall be extended for 0 days.

(21) Appl. No.: 09/126,807

(22) Filed: Jul. 31, 1998

(30) Foreign Application Priority Data

Aug. 11, 1997 (JP) ..... 9-216771

(51) Int. Cl.[7] ..... A61H 1/00

(52) U.S. Cl. ..... 601/2; 601/1; 601/34; 604/22; 604/23; 128/24; 310/316; 600/437; 606/41; 606/42

(58) Field of Search ..... 601/2, 1, 34; 604/22, 604/23; 128/24; 310/316; 600/437, 440, 442, 446; 606/42, 41

(56) References Cited

U.S. PATENT DOCUMENTS 4,311,922 * 1/1982 Puckette ..... 307/270
4,368,410 * 1/1983 Hance et al. ..... 318/116
4,614,178 * 9/1986 Harlt et al. ..... 601/2
4,708,127 * 11/1987 Abdelghani ..... 601/2
4,791,915 * 12/1988 Barsotti et al. ..... 601/2
5,086,788 * 2/1992 Castel et al. ..... 607/150
5,161,521 * 11/1992 Kasahara et al. ..... 601/2
5,618,275 * 4/1997 Bock ..... 604/290

FOREIGN PATENT DOCUMENTS 3013614 5/1995 (JP) .

* cited by examiner

*Primary Examiner*—Marvin M. Lateef
*Assistant Examiner*—Jeoyuh Lin
(74) *Attorney, Agent, or Firm*—Greenblum & Bernstein, P.L.C.

(57) ABSTRACT

Since the electrical impedance of an ultrasonic vibrator may vary according to the contact or non-contact of an application member with the skin, a detection circuit detects the contact or non-contact of the application member with the skin by converting the current the ultrasonic vibrator current into a voltage, and a comparator compares this voltage with a reference voltage. When contact is detected by the detection circuit, a constant-voltage circuit sets the level of the constant voltage output to the ultrasonic oscillation circuit at a standard voltage, but when non-contact is detected, the constant voltage is switched to a lower-level constant voltage. Thus, when non-contact is detected, the level of the ultrasound emitted from the ultrasonic vibrator via the application member is lowered, so that an unnecessary rise in the temperature of the application member is be prevented.

20 Claims, 9 Drawing Sheets

ULTRASONIC COSMETIC TREATMENT DEVICE

BACKGROUND OF THE INVENTION

1. Field of the Invention

The present invention relates to an ultrasonic cosmetic treatment device, and more specifically, to an ultrasonic cosmetic treatment device for encouraging the permeation of cosmetics into the skin.

2. Description of Relevant Materials

Registered Utility Model (Japanese) Gazette No. 3013614 (published May 10, 1995) describes one example of a conventional ultrasonic cosmetic treatment device. This conventional device is intended to achieve the effect of promoting the permeation of the cosmetic into the skin with an application of ultrasound. That is, after a specified cosmetic is applied to the face (or other skin area), a probe is used to apply ultrasound to the area of cosmetic application. In the conventional device, ultrasound is constantly output from the probe, whether or not the skin-contacting surface of the probe is actually in contact with the skin.

However, in the conventional device, although ultrasonic vibrations are propagated if the skin-contacting surface of the probe is in contact with the skin, ultrasonic vibrations are not propagated if the probe is placed against the skin in an improper manner. Accordingly, when the probe is placed against the skin in an improper manner, the intended effect is not satisfactorily achieved. Furthermore, since ultrasound is emitted at the same output value (set by the user) whether the probe is in contact with the skin or not, the probe generates heat when it is not in contact with the skin. That is, when the probe is not in contact with the skin, the vibration-propagating portion of the probe (which is preferably formed mainly from metal) generates heat as a result of the vibration. The temperature of this portion rises, causing discomfort. Furthermore, even if the ultrasonic vibrator undergoes abnormal oscillation during the generation of ultrasound, the user is unaware of the abnormal oscillation until the probe is placed against the skin.

SUMMARY OF THE INVENTION

An object of the invention is to provide an ultrasonic cosmetic treatment device that suppresses unnecessary rise in the temperature of the portion of the probe that contacts the skin, e.g., when the probe is not in contact with the skin.

Another object of the invention is to provide a safe ultrasonic cosmetic treatment device, i.e., a device that prevents the application of abnormal ultrasound to the user's skin.

In order to achieve the abovementioned objects, according to one aspect of the invention, an ultrasonic cosmetic treatment device includes a probe having an application member with a skin-contacting surface. An ultrasonic vibrator is attached to the opposite side of the application member from the skin-contacting surface. Circuits are provided in a housing, including: an ultrasonic oscillation circuit having an oscillation output for driving the ultrasonic vibrator and a detection circuit that detects contact and non-contact of the application member with the skin. An oscillation control circuit lowers a level of the oscillation output in response to a change from contact to non-contact of the application member with the skin, and increases the level of the oscillation output in response to a change from non-contact to contact of the application member with the skin.

Preferably, the application member is formed from metal.

Consequently, when the application member is not in contact with the skin, the level of the ultrasound that is emitted from the ultrasonic vibrator via the application member is lowered. Unnecessary rise in the temperature of the application member which contacts the skin is thereby suppressed.

In one modification, when the change from contact to non-contact of the application member with the skin is detected by the detection circuit, the oscillation control circuit lowers a level of the oscillation output after a predetermined delay time has elapsed.

In this case, the level of the ultrasound that is emitted from the ultrasonic vibrator via the application member is lowered only in the case of non-contact for a period longer than a predetermined delay time. Accordingly, even if the contacting state of the application member with the skin varies frequently during use, unnecessary increase or decrease in the level of the ultrasound is prevented.

In another modification, the ultrasonic cosmetic treatment device also includes a display that displays the status of contact or non-contact of the application member of the probe with the skin in accordance with detection results obtained by the detection device. Preferably, the display switches from a status display of contact to one of non-contact after a predetermined delay time has elapsed since the change from contact to non-contact of the application member with the skin is detected by the detection circuit.

As a result, the user is informed by the display of the contact or non-contact of the application member with the skin.

Furthermore, if the display switches from a contact display to a non-contact display only in the case of non-contact for a period exceeding a predetermined delay time, unnecessary display switching is prevented, even in cases where the contacting state of the application member with the skin varies frequently during use.

In a further modification, the oscillation control circuit includes a pulse oscillation circuit that outputs a control pulse signal that controls the application time of the oscillation output from the ultrasonic oscillation circuit to the ultrasonic vibrator. In this case, the ultrasonic cosmetic treatment device preferably includes a device for stopping the oscillating operation of the ultrasonic oscillation circuit when abnormalities occur in the control pulse signal output by the pulse oscillation circuit.

Accordingly, when abnormalities occur in the control pulse signal, no ultrasound is emitted from the ultrasonic vibrator, so that the application of undesirable abnormal ultrasound to the skin is prevented.

In another aspect of the invention, an ultrasonic cosmetic treatment device for application to the skin includes an ultrasonic vibrator probe for contacting the skin. An ultrasonic oscillation circuit vibrates the ultrasonic vibrator probe, and a detection circuit detects contact of the ultrasonic vibrator probe with the skin. An oscillation control circuit changes a level of vibration of the ultrasonic vibrator probe when the detection circuit detects a change in contact of the ultrasonic vibrator probe with the skin. The ultrasonic vibrator probe preferably includes an application member attached to an ultrasonic vibrator.

In this case, the oscillation control circuit preferably lowers a level of the oscillation output in response to a change from contact to non-contact of the application member with the skin, and increases the level of the oscillation output in response to a change from non-contact to contact of the application member with the skin.

More specifically, the detection circuit detects a change in contact of the ultrasonic vibrator probe with the skin by detecting a change in oscillation level caused by a change in impedance of the ultrasonic vibrator probe upon contact with the skin. The detection circuit may compare an envelope voltage of the oscillation level with a reference voltage to detect a change in contact of the ultrasonic vibrator probe with the skin.

Thus, when the application member is not in contact with the skin, the level of the ultrasound that is emitted from the ultrasonic vibrator probe is lowered. Unnecessary rise in the temperature of the probe (which contacts the skin) is thereby suppressed.

In one development of this aspect of the invention, a delay circuit is provided between the detection circuit and the oscillation control circuit. The delay circuit delays a signal from the detection circuit to the oscillation control circuit by a predetermined delay time, the oscillation control circuit thereby changing the level of vibration of the ultrasonic vibrator probe at the expiration of the predetermined delay time after the detection circuit detects a change in contact of the ultrasonic vibrator probe with the skin.

Preferably, the delay circuit includes a delay timer that begins counting the predetermined delay time when non-contact of the ultrasonic vibrator probe with the skin is detected by the detection circuit. When contact of the ultrasonic vibrator probe with the skin is detected during the predetermined delay time, the delay timer is interrupted and the counting is restarted.

Accordingly, the level of the ultrasound that is emitted from the ultrasonic vibrator probe is changed only in the case of a change in contact for a period longer than a predetermined delay time. Accordingly, even if the contacting state of the probe with the skin varies frequently during use, unnecessary changes in the level of the ultrasound are prevented.

The ultrasonic cosmetic treatment device according to this aspect of the invention optionally includes a display connected to the detection circuit that changes when the detection circuit detects a change in contact of the ultrasonic vibrator probe with the skin. The display may include a non-contact display part and a contact display part, and turns on one of the non-contact display part and the contact display part when the detection circuit detects a change in contact of the ultrasonic vibrator probe with the skin.

If a display is provided, a display delay circuit may also be provided that delays the change in the display by a predetermined delay time, the display thereby changing at the expiration of the predetermined delay time after the detection circuit detects a change in contact of the ultrasonic vibrator probe with the skin. In this case, the display delay circuit includes a delay timer that begins counting the predetermined delay time when a non-contact of the ultrasonic vibrator probe with the skin is detected by the detection circuit. When contact of the ultrasonic vibrator probe with the skin is detected during the predetermined delay time, the display delay timer is interrupted and the counting is restarted.

As a result, the user is informed by the display of the contact or non-contact of the application member with the skin. Furthermore, if the display changes only when a change in the contacting state change persists for longer than a predetermined delay time, unnecessary display switching is prevented, even in cases where the contacting state of the application member with the skin varies frequently during use.

In another development of this aspect of the invention, the ultrasonic cosmetic treatment device further includes a pulse oscillation circuit that outputs a control pulse signal that controls a vibration time of the ultrasonic vibrator probe, and a pulse-passing circuit that stops vibration of the ultrasonic vibrator probe when abnormalities occur in the control pulse signal output by the pulse oscillation circuit.

In such a case, the pulse-passing circuit may pass only control pulse signals having less than a predetermined pulse length. Alternatively, if the control pulse signals remain at one level for longer than the predetermined pulse length, the pulse-passing circuit blocks the transmission of the control pulse signals, thereby suppressing the vibration of the ultrasonic vibrator probe.

Accordingly, when abnormalities occur in the control pulse signal, no ultrasound is emitted from the ultrasonic vibrator probe, so that the application of undesirable abnormal ultrasound to the skin is prevented.

DETAILED DESCRIPTION OF THE PREFERRED EMBODIMENTS

Figure 1:
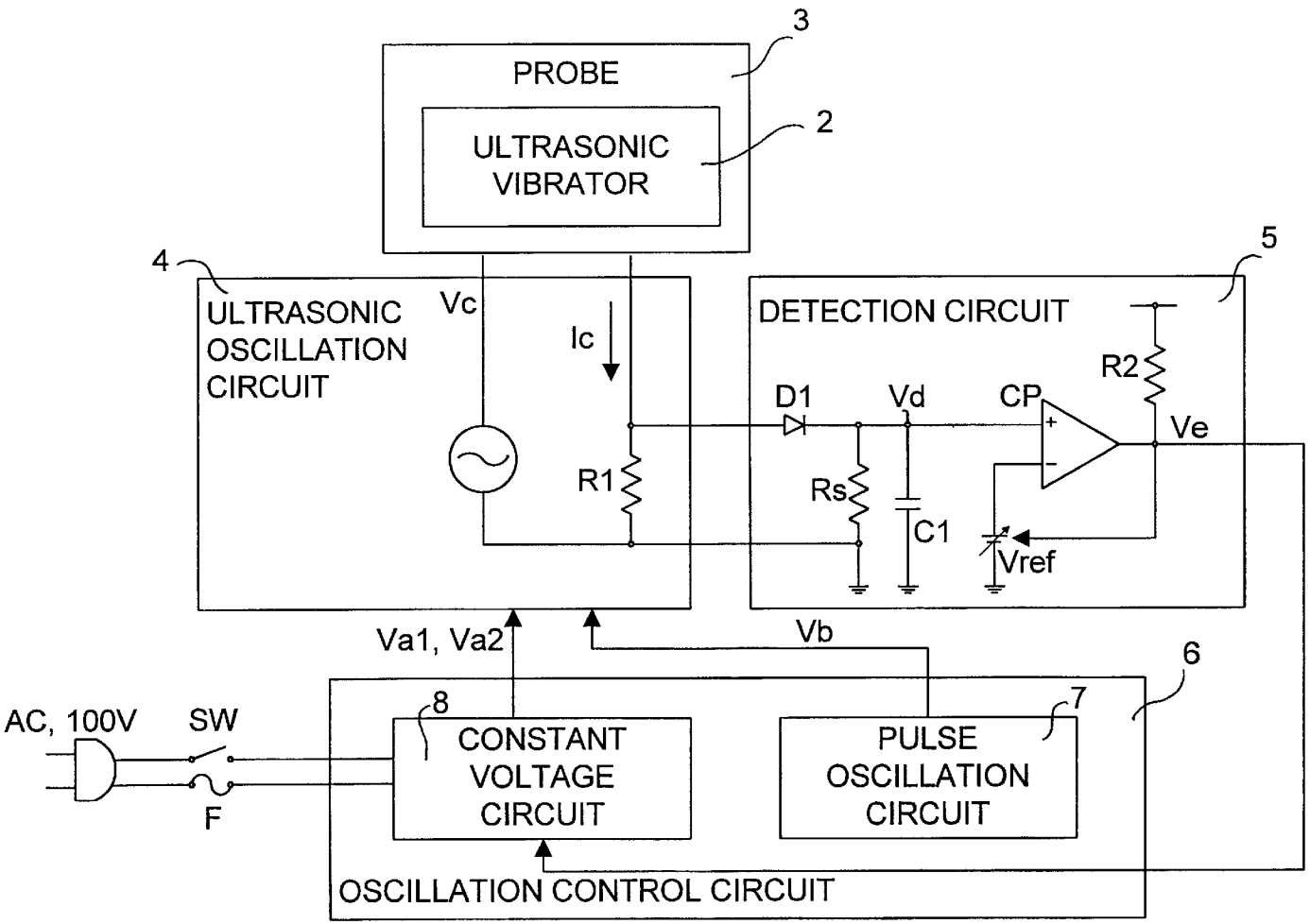
FIG. 1 is a block diagram of a first embodiment of an ultrasonic cosmetic treatment device according to the invention.

FIG. 1 shows a block diagram of a first embodiment of the present invention. The ultrasonic cosmetic treatment device of the first embodiment includes a probe 3, including a housing 3*a* (shown in FIG. 2). The probe 3 has a metal application member 1 mounted thereto, and an external (skin-contacting) surface 1*a* of the application member 1 may be applied to the skin of a user. An ultrasonic vibrator 2 is provided (within the housing 3*a*) on the opposite side of the application member 1 from the skin-contacting surface 1*a*.

The application member 1 is preferably metal because if the density (uniformity) of the skin-contacting portion that transmits the vibration is uneven, vibration propagation anomalies may be produced in the vibration when ultrasonic longitudinal waves, propagate through the transmitting portion. Consequently, ultrasonic waves may not be transmitted as intended. If a molded part (e.g., non-metal) is used, weld and sink marks are produced, which may cause the density to be uneven.

Further, the skin-contacting portion is preferably metal because it must have a certain degree of rigidity, so that it does not absorb longitudinal waves propagated therethrough. Although longitudinal waves propagate well through materials which have a high moisture content (e.g., gel), since it is impractical to construct durable and visually appealing cosmetic instruments from such materials, rigid materials (e.g., metal) are preferred.

It is preferable that the thickness of the application member 1 be an integral multiple of the longitudinal wavelength propagated therethrough, i.e., that generated by the ultrasonic vibrator 2. In this respect, since a change in thickness will hinder efficient longitudinal wave propagation, a material that resists dimensional change is superior. In this respect, again, metal is preferred.

Figure 2:
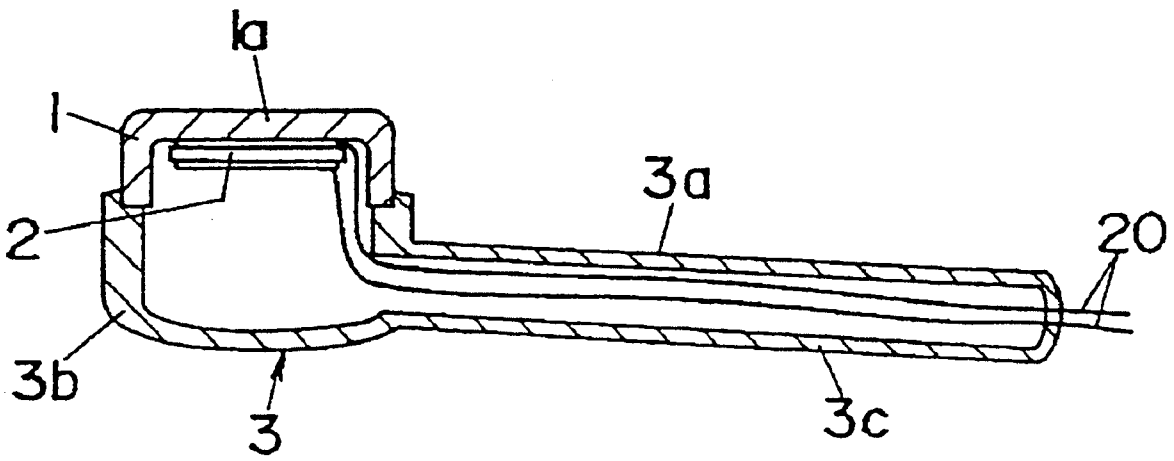
FIG. 2 is a sectional side view of the probe of FIGS. 1, 4, 6, and 8.

As shown in FIG. 2, the housing 3*a* of the probe 3 includes a handle 3*c* (which is gripped by the user) and a main body 3*b* at the distal end of the handle 3*c*. The application member 1 is attached to the main body 3*b*.

The application member 1 is formed in the shape of a cylinder with a bottom (e.g., an inverted cylindrical cup-shape). The ultrasonic vibrator 2 (including, for example, a piezo-electric element) is bonded to the back side (opposite side) of the skin-contacting surface 1*a* of the application member 1. When the ultrasonic vibrator 2 is excited, the vibration of the ultrasonic vibrator 2 propagates through the application member 1, so that ultrasound is externally emitted from the skin-contacting surface 1*a* of the application member 1.

As shown in FIG. 1, an ultrasonic oscillation circuit 4 drives the ultrasonic vibrator 2 via an (oscillation) output. It should be noted that the circuits of each of the first through fourth embodiments may be housed in a housing H separate from the probe 3. However, any circuits shown within the housing H may also be situated within the probe housing 3*a*. A detection circuit 5 connected to the ultrasonic oscillation circuit 2 detects the contacting state (contact or non-contact) of the probe's application member 1 with the skin. An oscillation control circuit 6, connected to both the ultrasonic oscillation circuit 4 and the detection circuit 5, controls the ultrasonic oscillation circuit 4 in response to the output of the detection circuit 5. That is, when the contacting state of the application member 1 changes from "contact" to "non-contact" (as detected by the detection circuit 5), the level (e.g., amplitude) of the oscillation output from the ultrasonic oscillation circuit 4 to the ultrasonic vibrator 2 is lowered from the level when the application member 1 contacts the skin. Conversely, when the contacting state changes from "non-contact" to "contact" (as detected by the detection circuit 5), the level (e.g., amplitude) of the oscillation output from the ultrasonic oscillation circuit 4 to the ultrasonic vibrator 2 is increased from the level when the application member 1 does not contact the skin. That is, the level (e.g., amplitude) of the oscillation output is higher for "contact" than for "non-contact".

The ultrasonic oscillation circuit 4 uses a well-known Colpitts oscillation circuit. The ultrasonic oscillation circuit 4 intermittently drives the ultrasonic vibrator 2 by applying an oscillating voltage Vc with a predetermined frequency (e.g., 1 MHZ) to the ultrasonic vibrator 2 via an electrical wire 20 (shown in FIG. 2) only while a control pulse signal Vb from the oscillation control circuit 6 is at an H (high) level. It should be noted that the numerical values described herein (e.g., those shown in parentheses) are merely reference values, and the present invention is not limited to the exemplary values.

The oscillation control circuit 6 includes a pulse oscillation circuit 7 that outputs the control pulse signal Vb (e.g., a square pulse signal with a frequency of 66 Hz and a duty ratio of 50%). The oscillation control circuit 6 also includes a constant-voltage circuit 8 which receives power from a commercial AC power supply (e.g., AC 100 V) via a power supply switch SW and a current fuse F. The constant-voltage circuit 8 outputs two types of constant voltages, i. e., high and low ($Va_1$=30 V and $Va_2$=20 V), to the ultrasonic oscillation circuit 4.

The detection circuit 5 includes a parallel circuit including a detection resistance Rs and a capacitor C1 connected in parallel (via a diode D1) to both ends of a resistance R1. The parallel circuit is inserted into the current path from the ultrasonic oscillation circuit 4 to the ultrasonic vibrator 2. Accordingly, the current Ic (e.g., 2 Amperes peak-to-peak —2A p-p) flowing to the ultrasonic vibrator 2 is converted into a voltage Vd (e.g., 2 V p-p), and the envelope is detected. The voltage Vd is compared with a reference voltage Vref by a comparator CP, and the result of this comparison (an H level or L level signal Ve) is output to the constant-voltage circuit 8 of the oscillation control circuit 6.

Specifically, when the application member 1 is not in contact with the skin, the vibration amplitude of the application member 1 reaches a maximum, and the electrical impedance of the ultrasonic vibrator 2 is reduced (e.g., to 20 ohms). Conversely, when the application member 1 is in contact with the skin, the vibration amplitude of the application member 1 is reduced, so that the impedance of the ultrasonic vibrator 2 increases (e.g., to 40 ohms). Accordingly, the contacting state (contact or non-contact) of the application member 1 with the skin can be detected according to the variation in the voltage value obtained by the envelope detection. Furthermore, the output of the comparator CP (which is pulled up by a resistance R2) is fed back to the reference voltage Vref, so that hysteresis is generated with respect to the reference voltage Vref (as described in detail later).

Figure 3:
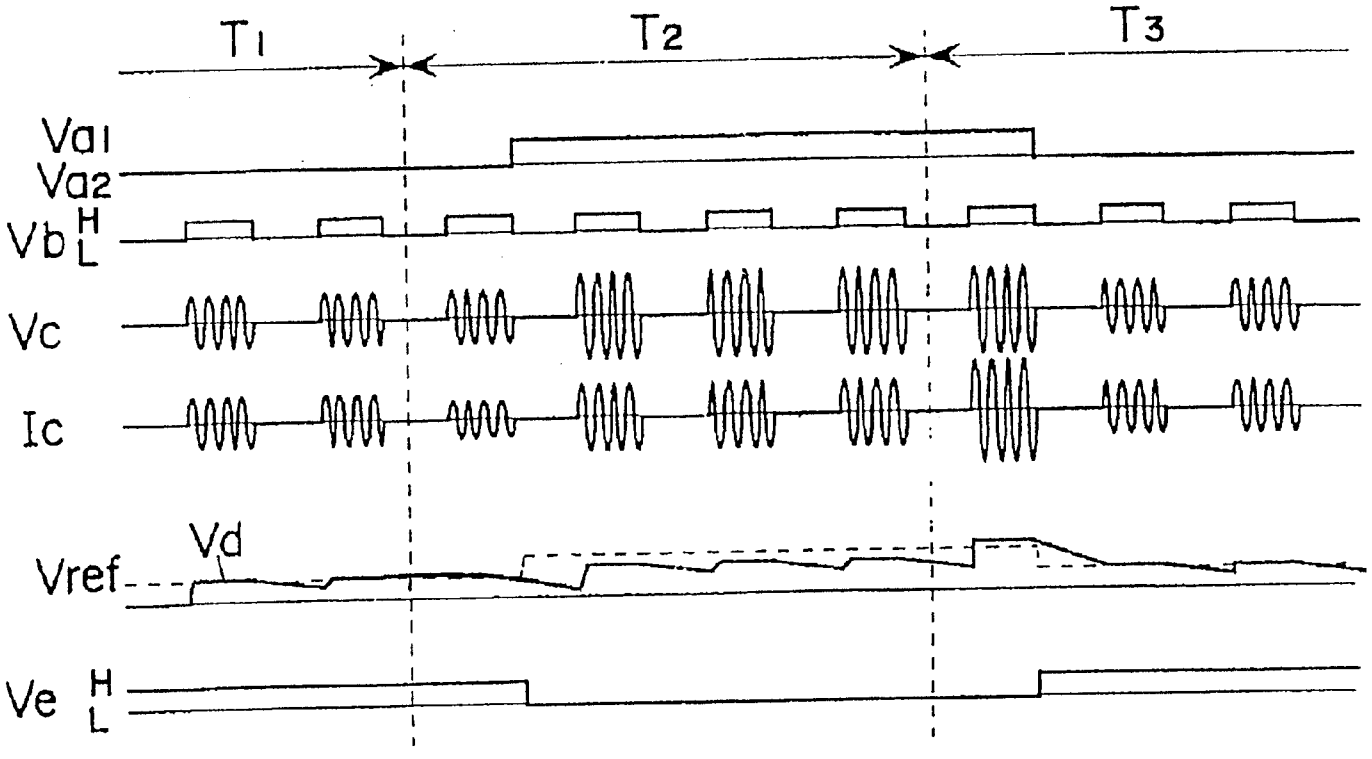
FIG. 3 is a timing chart of the operation of the ultrasonic cosmetic treatment device of FIG. 1.

FIG. 3 is a timing chart describing the operation of the first embodiment. Prior to initiation of use (a first operation), the application member 1 is not in contact with the skin (e.g., for a time T1 as shown in FIG. 3). When the power supply switch SW is closest so that the supply of power from the commercial AC power supply is initiated, a control pulse signal Vb (e.g., frequency: 66 Hz, duty ratio: 50%) is output from the pulse oscillation circuit 7 of the oscillation control circuit 6. Furthermore, a low-level constant voltage $Va_2$ is output to the ultrasonic oscillation circuit 4 from the constant-voltage circuit 8.

When the control pulse signal Vb and constant voltage $Va_2$ are thus input into the ultrasonic oscillation circuit 4, the ultrasonic oscillation circuit 4 outputs an oscillating voltage Vc with an intermittent burst waveform (e.g., oscillation frequency: 1 MHz, oscillation amplitude: 40 V p-p) in synchronization with the H level periods of the control pulse signal Vb to the ultrasonic vibrator 2.

The ultrasonic vibrator 2 receives the oscillating voltage Vc from the ultrasonic oscillation circuit 4 and vibrates, and the vibration is propagated to the application member 1. At this time, since the application member 1 is not in contact with the skin, the vibration amplitude of the application member 1 is at a maximum. Accordingly, the electrical impedance of the ultrasonic vibrator 2 is reduced (e.g., to 20 ohms). As a result, the value of the current Ic that flows to the ultrasonic vibrator 2 also increases (e.g., 2 A p-p).

In the detection circuit 5, the current Ic that flows to the ultrasonic vibrator 2 is converted into a voltage (e.g., 2 V p-p), and a voltage Vd obtained by the envelope detection is input into the comparator CP. In this case, the voltage Vd input into the comparator CP is substantially close to the peak value (e.g., 1 V), and is therefore higher than the reference voltage Vref (e.g., set at 0.9 V), i. e., Vd>Vref. Accordingly, it is determined that the application member 1 is not in contact with the skin, so that the detection voltage Ve output by the detection circuit 5 is set to the H level.

Furthermore, since the detection voltage Ve of the detection circuit 5 is at the H level, output of the low-level constant voltage $Va_2$ continues from the constant-voltage circuit 8 of the oscillation control circuit 6, so that the level of the ultrasound that is emitted from the ultrasonic vibrator 2 via the application member 1 is also kept at the lower level (e.g., 40 V p-p).

At initiation of use (a second operation), the application member is brought into contact with the skin (for a time T2 as shown in FIG. 3). For example, if the user holds the probe 3 and brings the application member 1 in contact with the skin, the vibration amplitude of the application member 1 is reduced; accordingly, the electrical impedance of the ultrasonic vibrator 2 increases (e.g., to 40 ohms), so that the current Ic flowing to the ultrasonic vibrator 2 drops (e.g., to 1 A p-p). As a result, the voltage Vd obtained by the envelope detection of the current Ic also drops (e.g., to 0.5 V) below the reference voltage Vref, i.e., Vd<Vref. Accordingly, it is determined that the application member 1 is in contact with the skin, and the detection voltage Ve output from the comparator CP changes to an L level voltage.

In the constant-voltage circuit 8, when the detection voltage Ve input from the detection circuit 5 changes to the L-level voltage, a high-level standard voltage $Va_1$ (e.g. 30 V) is output to the ultrasonic oscillation circuit 4. As a result, the amplitude of the oscillating voltage Vc output to the ultrasonic vibrator 2 from the ultrasonic oscillation circuit 4 increases (e.g., to 60 V p-p). Accordingly, the current Ic flowing to the ultrasonic vibrator 2 also increases (e.g., to 1.5 A p-p), so that the level of the ultrasound applied to the skin via the application member 1 is increased (compared to the level during the "non-contact" state).

At the same time, the output of the comparator CP changes to the L level, so that the reference voltage Vref increases as a result of hysteresis (e.g., from 0.9 V to 1.4 V). Moreover, since a high-level voltage $Va_1$ is output from the constant-voltage circuit 8, the voltage Vd obtained by the envelope detection increases (e.g., to 0.75 V). However, since the reference voltage Vref is increased as described above, the application member 1 is judged to be in a contacting state of "contact" (even if there is some fluctuation), so that the output of the comparator CP is maintained at the L level.

Following completion of use (a third operation), the application member is removed from the skin (for a time T3, as shown in FIG. 3). When the user removes the application member 1 of the probe 3 from the skin, the electrical impedance of the ultrasonic vibrator 2 again decreases (e.g., to 20 ohms). At this time, the amplitude of the oscillation voltage Vc output to the ultrasonic vibrator 2 from the ultrasonic oscillation circuit 4 is substantially at the maximum (e.g., 60 V p-p), so that the current Ic flowing F to the ultrasonic vibrator 2 increases (e.g., to 3 A p-p). The current Ic is converted to a voltage (e.g., 3 V p-p). Accordingly, the voltage Vd (e.g., which becomes 1.5 V because of the capacitor C1) increases beyond the reference voltage Vref (e.g., 1.4 V). As a result, it is judged that the application member 1 is not in contact with the skin, and the detection voltage Ve that is output from the comparator CP changes to an H level voltage.

When an H-level detection voltage Ve is input as a result of a judgement of non-contact by the detection circuit 5, a low-level constant voltage $Va_2$ (20 V p-p) is output to the ultrasonic oscillation circuit 4 from the constant-voltage circuit 8 of the oscillation control circuit 6. At the same time, the output of the comparator CP changes from H level to L level, so that the reference voltage Vref changes from 1.4 V to 0.9 V.

In the first embodiment, as described above, the detection circuit 5 detects the contact or non-contact of the application member 1 of the probe 3 with the skin. Accordingly, when the contacting state of the application member 1 with the skin is detected as "non-contact" by the detection circuit 5, unnecessary rise in the temperature of the application member 1 is suppressed by using the oscillation control circuit 6 to lower the level of the ultrasound emitted from the ultrasonic vibrator 2 via the application member 1. Furthermore, when the contacting state of the application member 1 with the skin is detected as "contact" by the detection circuit 5, the desired cosmetic treatment effect is obtained by using the oscillation control circuit 6 to increase the level of the ultrasound emitted from the ultrasonic vibrator 2 via the application member 1.

Figure 4:
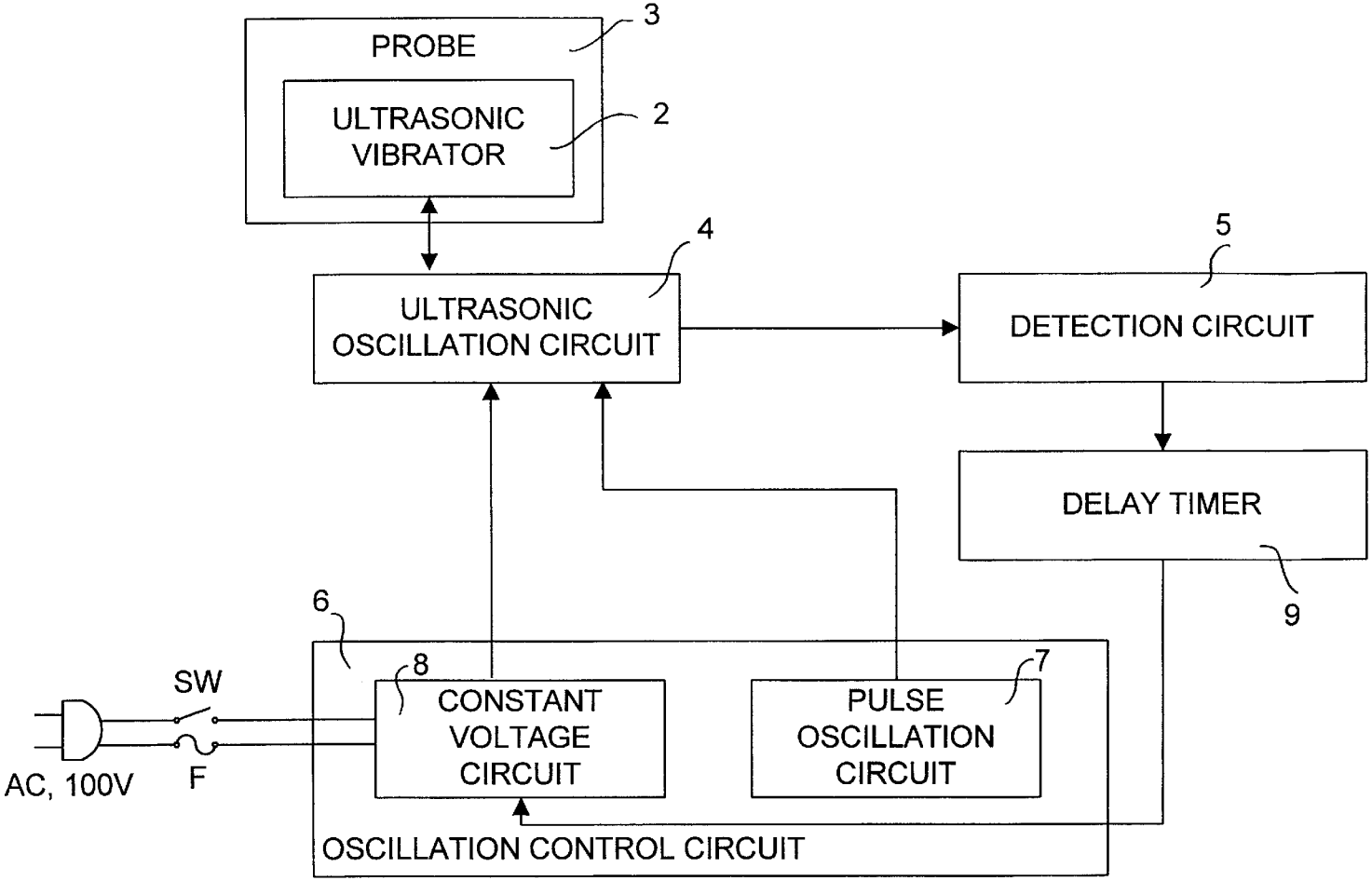
FIG. 4 is a block diagram of a second embodiment of an ultrasonic cosmetic treatment device according to the invention.

FIG. 4 shows a block diagram of the second embodiment of the present invention. As is shown in FIG. 4, the basic construction of the second embodiment is substantially similar to that of the first embodiment. Accordingly, elements which are common to both embodiments are labeled with the same symbols, and a description of such elements is omitted. Only those elements of the second embodiment different from those of the first embodiment are described.

In the first embodiment, the contacting state of the application member 1 with the skin varies frequently during use; accordingly, after a contacting state of "non-contact" has been detected by the detection circuit 5 and the level of the ultrasound has been lowered, even if the contacting state should again be detected as "contact" by the detection circuit 5 (and the level of the ultrasound returned to the original level), a time delay may be generated, so that the ultrasound level remains at a low level, preventing the desired cosmetic treatment effect. Accordingly, the second embodiment includes a delay timer 9 that delays the input of the detection voltage Ve output by the detection circuit 5 into the constant-voltage circuit 8 of the oscillation control circuit 6 by a predetermined delay time Td, so that the level of the ultrasound emitted from the ultrasonic vibrator 2 via the application member 1 is lowered only in the case of non-contact for a time exceeding the abovementioned delay time Td.

The delay timer 9 is triggered by an H-level detection voltage Ve input from the detection circuit 5, and begins to count the predetermined delay time Td (e.g., 3 seconds in the case of the second embodiment). When an L-level detection voltage Ve is output to the constant-voltage circuit 8 during the counting of the delay time Td, an H-level detection voltage Ve is output following the completion of the counting of the delay time Td, and the detection voltage Ve input from the detection circuit 5 changes to an L level during the counting of the delay time Td. Accordingly, the count is thus interrupted and reset.

Figure 5:
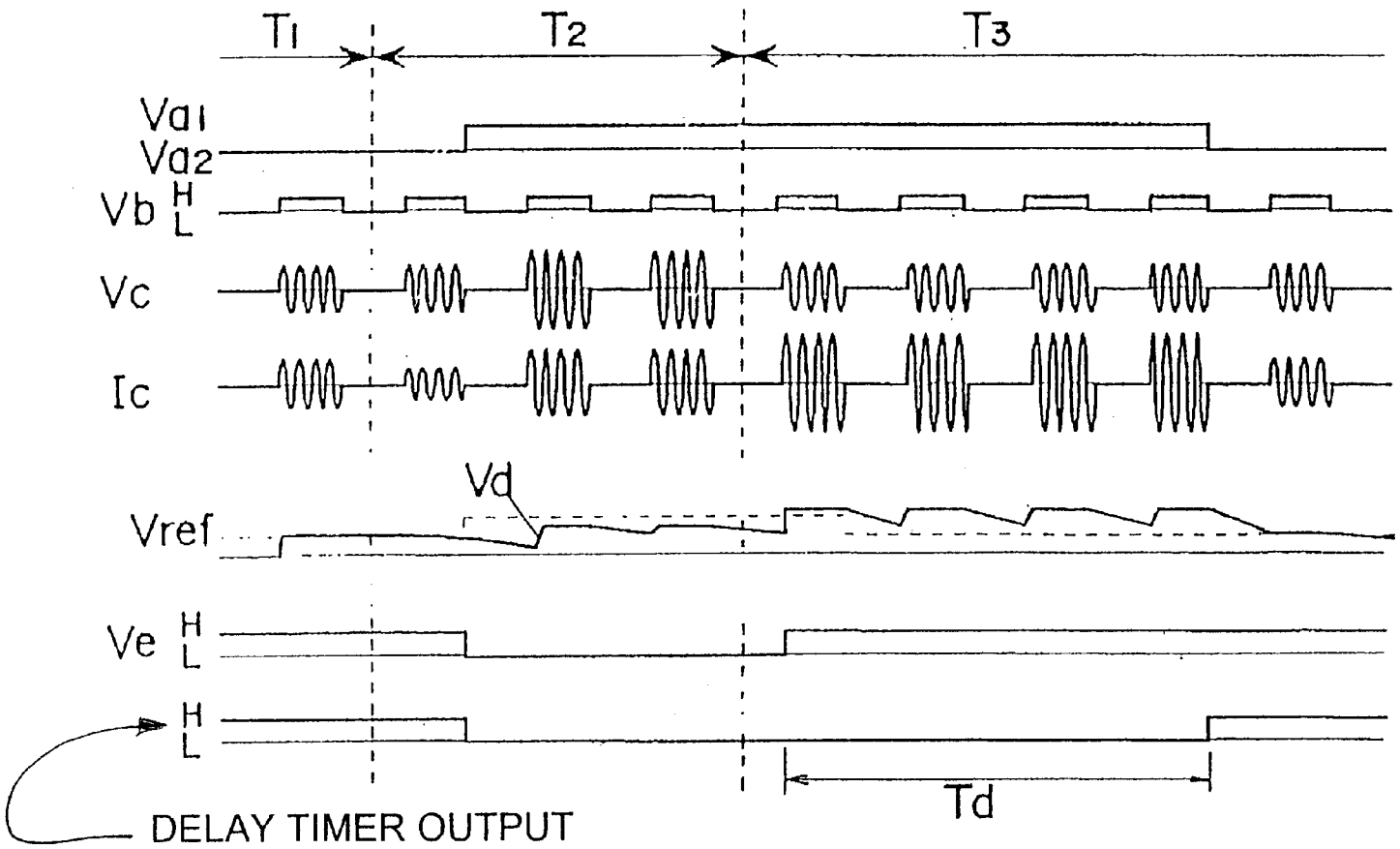
FIG. 5 is a timing chart of the operation of the ultrasonic cosmetic treatment device of FIG. 4.

The timing chart of FIG. 5 describes the operation of the second embodiment. The operations prior to the initiation of use (e.g., the time T1 during which the application member 1 is not in contact with the skin) and when use is initiated (e.g., the time T2 during which the application member is in contact with the skin) are similar to the first embodiment. Accordingly, description of the operations prior to initiation of use and when use is initiated is omitted.

In the second embodiment, during use, the application member 1 may be temporarily removed from the skin (for a time T3 as shown in FIG. 5), for example, in order to move the application member from the cheek to the jaw. When the application member 1 is removed from the skin, the detection circuit 5 detects a contacting state of "non-contact", so that an H-level detection voltage Ve is input into the delay timer 9, When the H-level detection voltage Ve is thus input, the delay timer 9 begins to count the delay time Td. Accordingly, an L-level detection voltage Ve that indicates a contacting state of "contact" continues to be output from the delay timer 9 to the constant-voltage circuit 8 of the oscillation control circuit 6 during this count. As a result, a high-level standard voltage $Va_1$ is output to the ultrasonic oscillation circuit 4 from the constant-voltage circuit 8, so that the level (amplitude) of the ultrasound emitted via the application member 1 is also maintained at a high level.

In this case, when the application member 1 contacts the skin during the counting of the delay time Td, an L level detection voltage Ve is input to the delay timer 9 from the detection circuit 5. When the L level detection voltage Ve is thus input during the counting of the delay time Td, the delay timer 9 resets the count, so that the count is interrupted. Consequently, a high-level standard voltage $Va_1$ is output to the ultrasonic oscillation circuit 4 from the constant-voltage circuit 8, so that the level (amplitude) of the ultrasound that is emitted via the application member 1 is maintained at a high level. (i.e., as is).

Conversely, when the application member 1 is removed from the skin for a time exceeding the delay time Td, the count of the delay timer 9 completes. Consequently, an H level detection voltage Ve is output to the constant-voltage circuit 8. In the constant-voltage circuit 8, when the detection voltage Ve input from the detection circuit 5 via the delay timer 9 changes to the H-level voltage, a low-level constant voltage $Va_2$ is output to the ultrasonic oscillation circuit 4. At the same time, the output of the comparator CP changes from the L level to the H level, so that the reference voltage Vref is decreased (e.g., changes from 1.4 V to 0.9 V).

In the second embodiment, as described above, a delay timer 9 is provided which delays (by a delay time Td) the output of an H-level detection voltage Ve to the oscillation control circuit 6 when the detection voltage Ve output by the detection circuit 5 changes from an L level ("contact") to an H level ("non-contact"). As a result, when a change from a contacting state of "contact" to one of "non-contact" is detected by the detection circuit 5, the level of the output from the ultrasonic oscillation circuit 4 to the ultrasonic vibrator 2 is lowered after the delay time Td has elapsed. That is, the level of the output from the ultrasonic oscillation circuit 4 to the ultrasonic vibrator 2 is lowered by the oscillation control circuit 6 to a level lower than that of the level of the output in a contacting state of "contact". Accordingly, since the level of the ultrasound that is emitted from the ultrasonic vibrator 2 via the application member 1 is lowered only when the state of "non-contact" extends longer than the predetermined delay time Td, stable use is possible. That is, unnecessary increase or decrease of the ultrasound level is prevented, even in cases where the contacting state of the application member 1 with the skin varies frequently during use.

Figure 6:
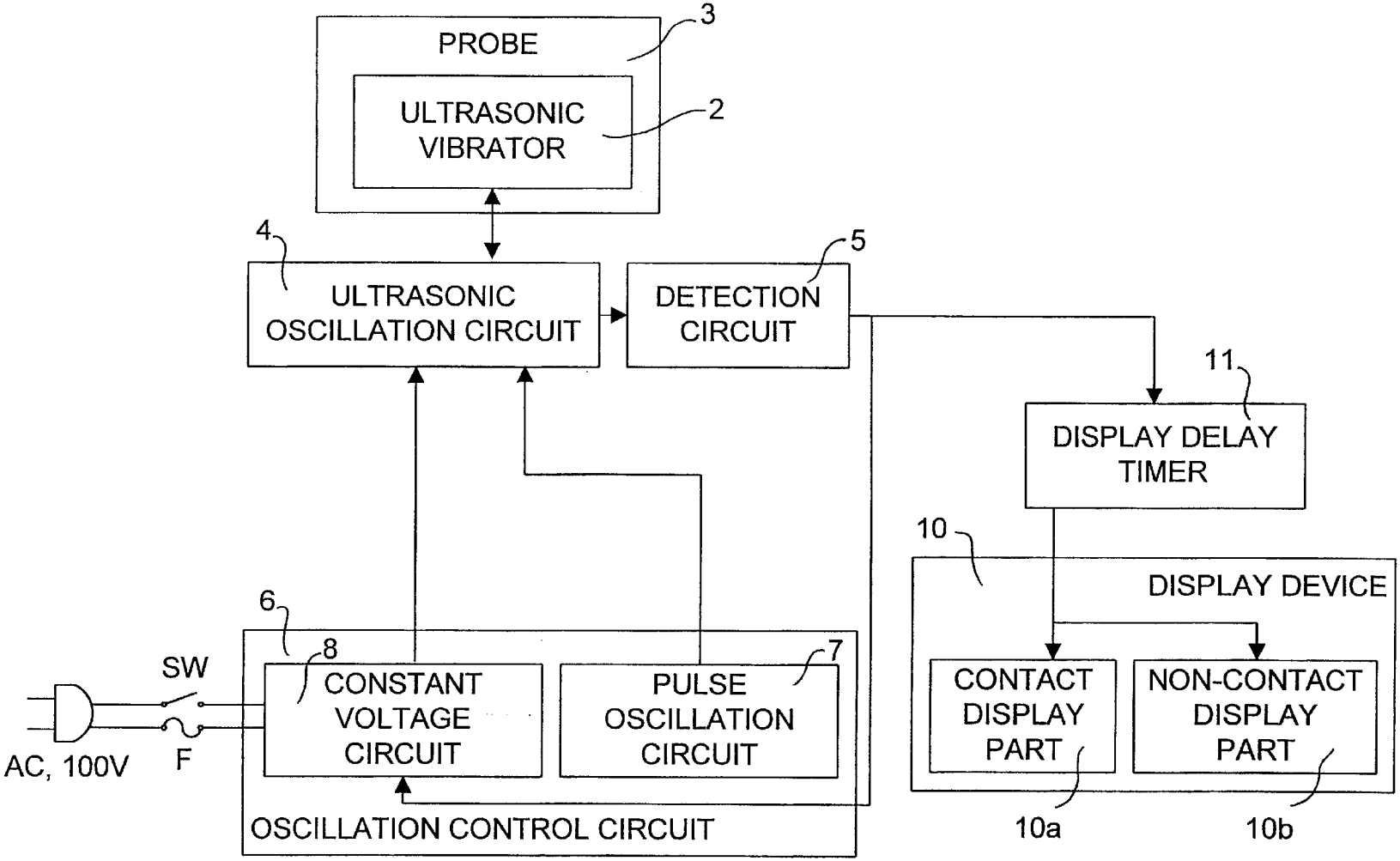
FIG. 6 is a block diagram of a third embodiment of an ultrasonic cosmetic treatment device according to the invention.

FIG. 6 shows a block diagram of the third embodiment of the present invention. As shown in FIG. 6, the basic construction of the third embodiment is substantially similar to that of the first embodiment. Accordingly, elements which are common to both embodiments are labeled with the same symbols, and a description of such elements is omitted. Only those elements of the third embodiment different from those of the first embodiment are described.

In the third embodiment, the ultrasonic cosmetic treatment device includes a display device 10 that displays (indicates) the contacting state (contact or non-contact) of the application member 1 of the probe 3 with the skin in accordance with the detection results obtained by the detection circuit 5. The display device 10 may be in the housing H separate from the housing of the probe 3. The device further includes a display delay timer 11 which delays (by a predetermined delay time $Td_2$), the input into the display device 10 of the detection voltage Ve output by the detection circuit 5. The display device 10 and the display delay timer 11 together form a display for displaying the contacting state.

The display device includes a contact display part 10*a* and a non-contact display part 10*b* (preferably including light-emitting elements such as light emitting diodes or the like). When the detection circuit 5 detects that the application member 1 is in contact with the skin, the contact display part 10*a* is lit, and the non-contact display part 10*b* is extinguished. Conversely, when the detection circuit 5 detects that the application member 1 is not in contact with the skin, the contact display part 10*a* is extinguished, and the non-contact display part 10*b* is lit. In this way, the user is informed of the contacting state (contact or non-contact) of the application member 1 with the skin.

The display delay timer 11 is triggered by an H-level detection voltage Ve input from the detection circuit 5, and begins to count a predetermined delay time $Td_2$ (e.g., 2 seconds in the case of the third embodiment). When an L-level detection voltage Ve is output to the display device 10 during the counting of the delay time $Td_2$, an H-level detection voltage Ve is output following the completion of the counting of the delay time $Td_2$, and the detection voltage Ve input from the detection circuit 5 changes to the L level during the counting of the delay time $Td_2$. Consequently, the count is interrupted and reset.

Figure 7:
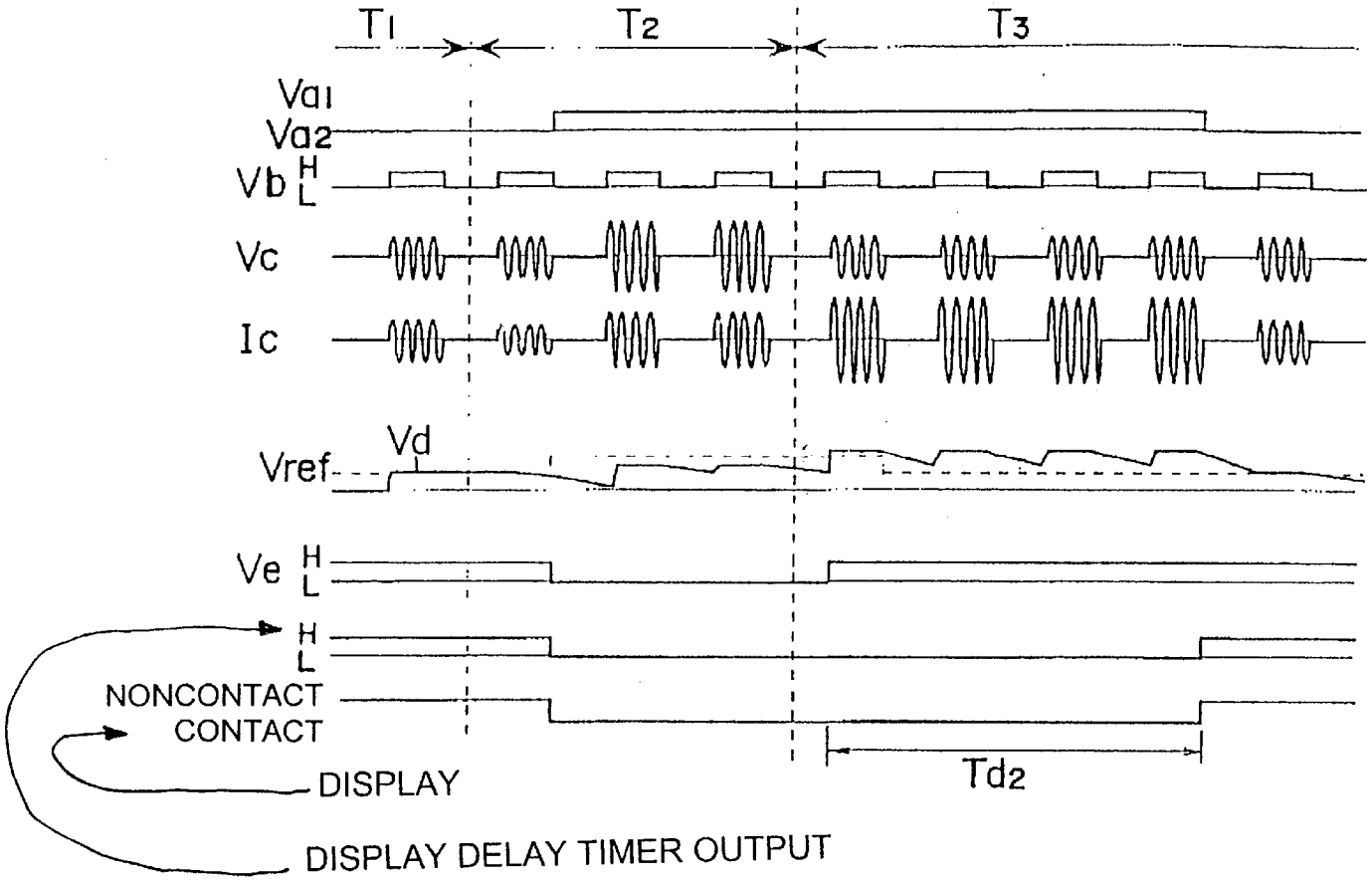
FIG. 7 is a timing chart of the operation of the ultrasonic cosmetic treatment device of FIG. 6.

The timing chart of FIG. 7 describes the operation of the third embodiment. Prior to initiation of use (a first operation), the application member 1 is not in contact with the skin (during a time T1 as shown in FIG. 7). The detection circuit 5 detects a contacting state of "non-contact", and inputs an H-level detection voltage Ve into the display delay timer 11. The display delay timer 11 outputs the H-level detection voltage Ve ("as is") to the display device 10, so that the contact display part 10*a* of the display device 10 is switched off (extinguished) and the non-contact display part 10*b* is switched on (lit).

At initiation of use (a second operation), the application member is in contact with the skin (during a time T2, as shown in FIG. 7). Consequently, the detection circuit 5 detects a contacting state of "contact" and inputs an L-level detection voltage Ve to the display delay timer 11. When the level of the detection voltage Ve changes from the H level to the L level, the display delay timer 11 immediately outputs an L-level signal to the display device 10. Accordingly, the contact display part 10*a* of the display device 10 is switched on (lit), and the non-contact display part 10*b* is switched off (extinguished).

During use (a third operation), the application member 1 may be temporarily removed from the skin, for example, in order to move the application member from the cheek to the jaw (during a time T3, as shown in FIG. 7). When the application member 1 is removed from the skin, the detection circuit 5 detects a contacting state of "non-contact", and inputs an H level detection voltage Ve to the display delay timer 11. When the level of the detection voltage Ve changes from the L level to the H level, the display delay timer 11 begins to count the delay time $Td_2$, and continues to output the L level detection voltage Ve (indicating a contacting state of "contact") to the display device 10 during the count. As a result, the contact display part 10*a* remains on (lit), and the non-contact display part 10*b* remains off (extinguished).

If the application member 1 is brought into contact with the skin during the counting of the delay time $Td_2$, an L level detection voltage Ve is input to the display delay timer 11 from the detection circuit 5. When the L-level detection voltage Ve is thus input during the counting of the delay time $Td_2$, the display delay timer 11 resets the count, so that the count is interrupted. Accordingly, the contact display part 10*a* of the display device 10 remains on (lit), and the non-contact display part 10*b* remains off (extinguished).

Conversely, if the application member 1 is removed from the skin for a time exceeding the delay time $Td_2$, the count of the display delay timer 11 completes, and an H-level detection voltage Ve is output to the display device 10. In the display device 10, when the detection voltage Ve input from the detection circuit 5 via the display delay timer 11 changes to the H level, the contact display part 10*a* is switched off (extinguished), and the non-contact display part 10*b* is switched on (lit).

In the third embodiment, as described above, the device includes a display device 10 that displays the contacting state (contact or non-contact) of the application member 1 of the probe 3 with the skin in accordance with the detection results obtained by the detection circuit 5. The third embodiment further includes a display delay timer 11 that delays the output of the detection voltage Ve to the display device 10 by counting a predetermined delay time $Td_2$ when a change from a contacting state of "contact" to one of "non-contact" is detected by the detection circuit 5. Accordingly, the user is informed of the contact or non-contact of the application member 1 with the skin by the display device 10.

Furthermore, since the display device 10 is switched from a contact display to a non-contact display only when the non-contact state extends longer than the predetermined delay time $Td_2$, a stable display is achieved. That is, unnecessary switching between a contact display and non-contact display is prevented, even in cases where the contacting state of the application member 1 with the skin changes frequently during use.

Figure 8:
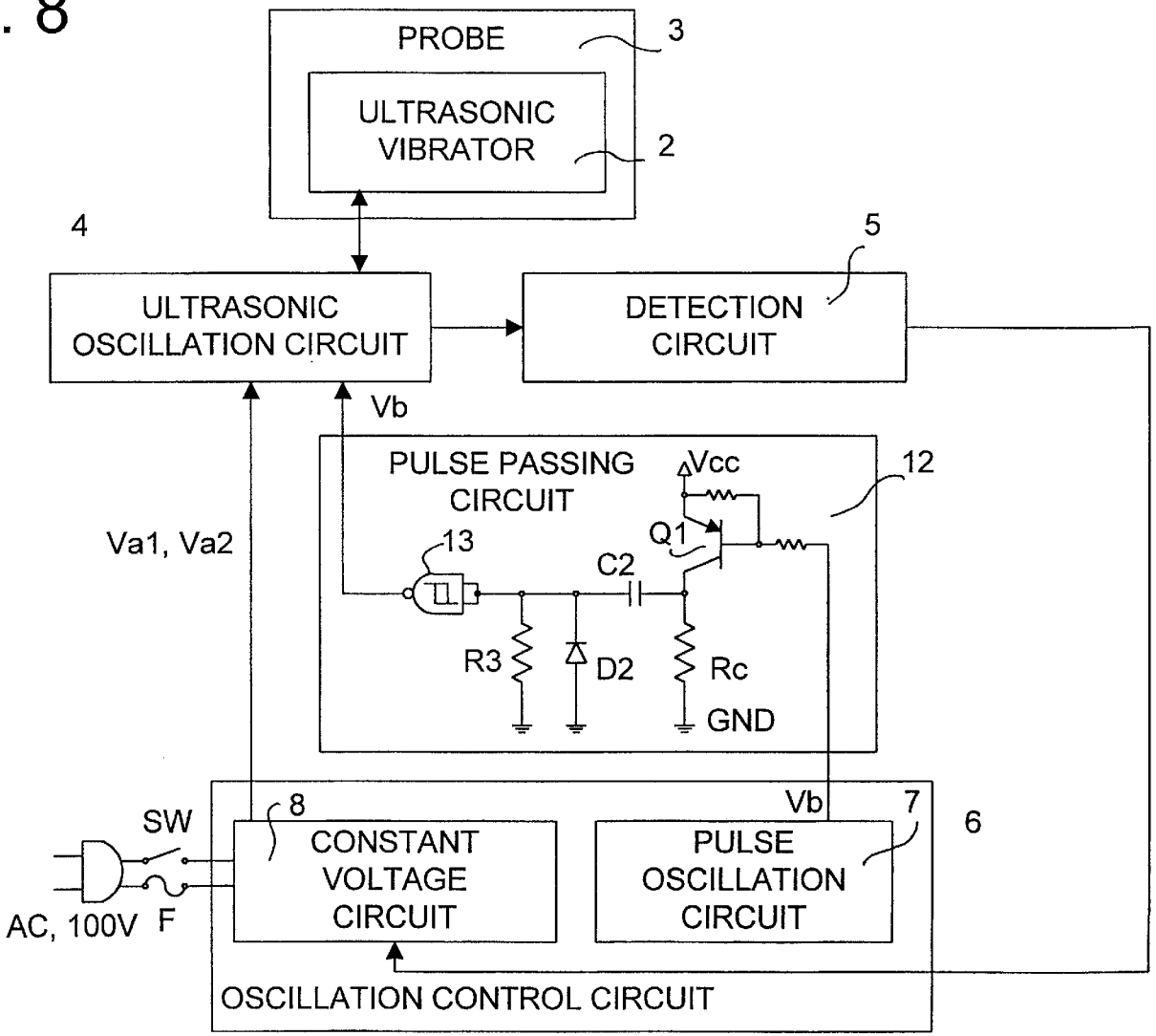
FIG. 8 is a block diagram of a fourth embodiment of an ultrasonic cosmetic treatment device according to the invention.

FIG. 8 shows a block diagram of the fourth embodiment of the present invention. As shown in FIG. 8, the basic construction of the fourth embodiment is substantially similar to that of the first embodiment. Accordingly, elements which are common to both embodiments are labeled with the same symbols, and a description of such elements is omitted. Only those elements of the fourth embodiment different from those of the first embodiment are described.

In the fourth embodiment, the ultrasonic cosmetic application device includes a pulse-passing circuit 12 that stops the oscillating operation of the ultrasonic oscillation circuit 4 when abnormalities occur in the control pulse signal Vb output from the pulse oscillation circuit 7 of the oscillation control circuit 6. It should be noted that the ultrasonic oscillation circuit 4 outputs an oscillating voltage Vd with a predetermined frequency Vc only during periods when the control pulse signal Vb from the oscillation control circuit 6 is at an L level.

The pulse-passing circuit 12 includes a transistor Q1 that is switched on and off by the control pulse signal Vb output from the pulse oscillation circuit 7, and a parallel circuit including a resistance R3 and a diode D2 parallel-connected to a collector resistance Rc of the transistor Q1 via a capacitor C2. Further, the pulse-passing circuit 12 includes a Schmidt input NOT gate 13 that inputs the voltage across the ends of the resistance R3. The pulse-passing circuit allows only pulse signals with a predetermined length to pass.

When an L level control pulse signal Vb is input into the base of the transistor Q1, the transistor Q1 is switched on, so that the collector of the transistor Q1 assumes an H level. The L level control pulse signal Vb is thereby input into the NOT gate 13 via the capacitor C2. Since the NOT gate 13 inverts the input signal and outputs the resulting inverted signal, an L level signal is ultimately output from the pulse-passing circuit 12. On the other hand, when the control pulse signal Vb is an H level signal, the transistor Q1 is switched off. In this case, the collector of the transistor Q1 is pulled down by the resistance Rc, and thereby assumes the L level. Since the L level signal is input into the NOT gate 13 via the capacitor C2, the output from the pulse-passing circuit 12 is an H-level output. Thus, under ordinary conditions, the pulse-passing circuit 12 outputs (passes) a pulse signal that is the same as the control pulse signal Vb (input from the pulse oscillation circuit 7) to the ultrasonic oscillation circuit 4.

If the oscillation control circuit 6 (previously described in detail) is, for example, constructed from an integrated (e.g., one-chip) microcomputer, and control is lost due to noise, etc., the control pulse signal Vb may become (abnormally) fixed at the H level or L level.

However, with the pulse-passing circuit 12 of the fourth embodiment, if the control pulse signal Vb becomes (abnormally) fixed at the H level, the transistor Q1 remains off, so that the input to the NOT gate 13 is fixed at the L level. Accordingly, the output of the pulse-passing circuit 12 is also fixed at the H level.

Conversely, if the control pulse signal Vb becomes (abnormally) fixed at the L level, the transistor Q1 remains on, and an H level signal is input into the NOT gate 13 via the capacitor C2. However, the input level of the NOT gate 13 drops to the L level after a predetermined time Tn has elapsed, because of the action of the resistance R3. As a result, if the control pulse signal Vb is at the L level for a time exceeding the predetermined time Tn, the output level of the pulse-passing circuit 12 switches from L to H, so that the passage of the control pulse signal Vb to the ultrasonic oscillation circuit 4 is blocked. The abovementioned predetermined time Tn is determined by the setting of the constants of the resistance R3 and capacitor C2, and the input threshold voltage of the NOT gate 13. In the present embodiment, the predetermined time Tn is set at a time (e.g., 15 ms) sufficiently longer than the pulse width of the control pulse signal Vb (e.g., 7.5 ms) that the normal control pulse signal Vb is passed through.

Figure 9:
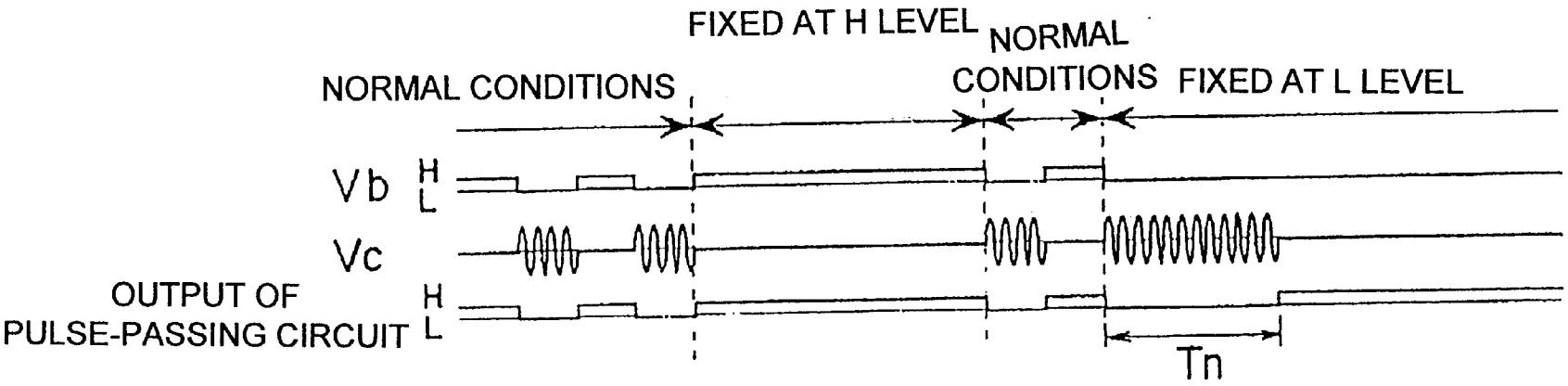
FIG. 9 is a timing chart of the operation of the ultrasonic cosmetic treatment device of FIG. 8.

The timing chart of FIG. 9 describes the operation of the fourth embodiment. First, in cases where a normal control pulse signal Vb is output from the pulse oscillation circuit 7 of the oscillation control circuit 6, the pulse-passing circuit 12 passes the control pulse signal Vb as is, and outputs the control pulse signal Vb to the ultrasonic oscillation circuit 4. Then, when the control pulse signal Vb and the constant voltage $Va_2$ from the constant-voltage circuit 8 are input into the ultrasonic oscillation circuit 4, the ultrasonic oscillation circuit 4 outputs an oscillating voltage Vc with an intermittent burst waveform (e.g., oscillation frequency: 1 MHz, oscillation amplitude: 20 V p-p) in synchronization with the L level periods of the control pulse signal Vb to the ultrasonic vibrator 2. The ultrasonic vibrator 2 receives the oscillating voltage Vc from the ultrasonic oscillation circuit 4 and vibrates, and the vibration is propagated to the application member 1.

However, if the control pulse signal Vb becomes (abnormally) fixed at the H level, the output of the pulse-passing circuit 12 is also fixed at the H level. Accordingly, the output of the oscillating voltage Vc from the ultrasonic oscillation circuit 4 is stopped, and the vibration of the ultrasonic vibrator 2 stops.

Conversely, if the control pulse signal Vb becomes (abnormally) fixed at the L level, an L-level control pulse signal Vb passes through the pulse-passing circuit 12, and is input into the ultrasonic oscillation circuit 4 until the predetermined time Tn has elapsed. Accordingly, the output of the oscillating voltage Vc from the ultrasonic oscillation circuit 4 continues. However, when the predetermined time Tn has elapsed, the pulse-passing circuit 2 blocks the L-level control pulse signal Vb, so that an H-level signal is output to the ultrasonic oscillation circuit 4. Accordingly, the output of the oscillating voltage Vc from the ultrasonic oscillation circuit 4 is stopped.

Thus, in the fourth embodiment, if the control pulse signal Vb becomes (abnormally) fixed at the H level or fixed at the L level (I. e., in the case of a pulse length that—at least—exceeds the predetermined time Tn), the output of the oscillating voltage Vc from the ultrasonic oscillation circuit 4 is forcibly stopped. Consequently, the emission of ultrasound from the ultrasonic vibrator 2 is suppressed when abnormalities occur in the control pulse signal Vb, preventing the application of undesirable abnormal ultrasound to the user's skin.

Thus, in the described embodiments, when the application member is not in contact with the skin, the level of the ultrasound that is emitted from the ultrasonic vibrator via the application member is lowered, so that unnecessary rise in the temperature of the application member which contacts the skin is suppressed.

In the second embodiment, the level of the ultrasound that is emitted from the ultrasonic vibrator via the application member is lowered only in the case of non-contact for a period longer than a predetermined delay time. Accordingly, even if the contacting state of the application member with the skin varies frequently during use, stable use is possible. That is, unnecessary increase or decrease in the level of the ultrasound is prevented.

In the third embodiment, the user is informed by the display of the contact or non-contact of the application member with the skin. Furthermore, since the display may switch from a contact display to a non-contact display only in the case of non-contact for a period exceeding a predetermined delay time, a stable display is possible. That is, unnecessary switching between the contact display and non-contact display is prevented, even in cases where the contacting state of the application member with the skin varies frequently during use.

In the fourth embodiment, in cases where abnormalities occur in the control pulse signal, no ultrasound is emitted from the ultrasonic vibrator, so that the application of undesirable abnormal ultrasound to the skin can be prevented.

Although the above description sets forth particular embodiments of the present invention, modifications of the invention will be readily apparent to those skilled in the art, and it is intended that the scope of the invention be determined solely by the appended claims.

The present disclosure relates to subject matter contained in Japanese Patent Application No. HEI 9-216771, filed on Aug. 11, 1997, which is expressly incorporated herein by reference in its entirety.

What is claimed is:

1. An ultrasonic cosmetic treatment device for treating the skin, comprising:

an ultrasonic vibrator probe that contacts a skin;

an ultrasonic oscillation circuit that moves the ultrasonic vibrator probe;

a detection circuit that converts an impedance of the ultrasonic vibrator into an envelope voltage of an oscillation level and detects contact and non-contact of the ultrasonic vibrator probe with the skin by comparing the envelope voltage of the oscillation level with a reference voltage;

an oscillation control circuit that changes an oscillation output level applied to the ultrasonic vibrator probe when the detection circuit detects a change between the contact and non-contact of the ultrasonic vibrator probe with the skin.

2. The ultrasonic cosmetic treatment device according to claim 1, said oscillation control circuit including a pulse oscillation circuit that outputs a control pulse signal that controls the application time of the oscillation output from said ultrasonic oscillation circuit to said ultrasonic vibrator, and further comprising:

means for stopping the oscillating operation of said ultrasonic oscillation circuit when abnormalities occur in the control pulse signal output by said pulse oscillation circuit.

3. The ultrasonic cosmetic treatment device according to claim 1, wherein said ultrasonic vibrator probe comprises an application member attached to an ultrasonic vibrator.

4. The ultrasonic cosmetic treatment device according to claim 3, wherein said oscillation control circuit lowers a level of the oscillation output after a predetermined delay time has elapsed since the change from contact to non-contact of the application member with the skin is detected by said detection circuit.

5. The ultrasonic cosmetic treatment device according to claim 3, further comprising:

a display that displays the status of contact or non-contact of the application member of said probe with the skin in accordance with the detection results obtained by said detection device, and switches from a status display of contact to one of non-contact after a predetermined delay time has elapsed since the change from contact to non-contact of said application member with the skin is detected by said detection circuit.

6. The ultrasonic cosmetic treatment device according to claim 5, further comprising:

a display delay circuit that delays said change in said display by a predetermined delay time, said display thereby changing at the expiration of the predetermined delay time after said detection circuit detects a change in contact of said ultrasonic vibrator probe with the skin.

7. The ultrasonic cosmetic treatment device according to claim 6, wherein said display delay circuit includes a delay timer that begins counting the predetermined delay time when non-contact of said ultrasonic vibrator probe with the skin is detected by said detection circuit, and wherein when contact of said ultrasonic vibrator probe with the skin is detected during the predetermined delay time, the display delay timer is interrupted and the counting is restarted.

8. The ultrasonic cosmetic treatment device according to claim 3, wherein said application member comprises a metal.

9. The ultrasonic cosmetic treatment device according to claim 3, wherein the oscillation control circuit lowers a level of the oscillation output in response to a change from contact to non-contact of said application member with the skin, and increases the level of the oscillation output in response to a change from non-contact to contact of said application member with the skin.

10. The ultrasonic cosmetic treatment device according to claim 1, further comprising:

a delay circuit between the detection circuit and the oscillation control circuit that delays a signal from the detection circuit to the oscillation control circuit by a predetermined delay time, said oscillation control circuit thereby changing the level of vibration of said ultrasonic vibrator probe at the expiration of the predetermined delay time after said detection circuit detects a change in contact of said ultrasonic vibrator probe with the skin.

11. The ultrasonic cosmetic treatment device according to claim 10, wherein said delay circuit includes a delay timer that begins counting the predetermined delay time when non-contact of said ultrasonic vibrator probe with the skin is detected by said detection circuit, and wherein when contact of said ultrasonic vibrator probe with the skin is detected during the predetermined delay time, the delay timer is interrupted and the counting is restarted.

12. The ultrasonic cosmetic treatment device according to claim 1, further comprising:

a display connected to said detection circuit that changes when said detection circuit detects a change in contact of said ultrasonic vibrator probe with the skin.

13. The ultrasonic cosmetic treatment device according to claim 12, wherein said display comprises a non-contact display part and a contact display part, and wherein said display turns on one of said non-contact display part and said contact display part wherein said detection circuit detects a change in contact of said ultrasonic vibrator probe with the skin.

14. The ultrasonic cosmetic treatment device according to claim 1, further comprising:

a pulse oscillation circuit that outputs a control pulse signal that controls a vibration time of the ultrasonic vibrator probe; and a pulse-passing circuit that stops vibration of the ultrasonic vibrator probe when abnormalities occur in the control pulse signal output by said pulse oscillation circuit.

15. The ultrasonic cosmetic treatment device according to claim 14, wherein said pulse-passing circuit passes only control pulse signals having less than a predetermined pulse length.

16. The ultrasonic cosmetic treatment device according to claim 14, wherein if the control pulse signals remain at one level for longer than said predetermined pulse length, said pulse-passing circuit blocks the transmission of said control pulse signals, thereby suppressing the vibration of said ultrasonic vibrator probe.

17. The ultrasonic cosmetic treatment device according to claim 1, wherein the detection circuit changes the reference voltage when detecting the change of contact and non-contact of the ultrasonic vibrator probe with the skin.

18. An ultrasonic cosmetic treatment device for treating skin, comprising:

a probe having an application member with a skin-contacting surface;

an ultrasonic vibrator attached to a side of said application member opposite from said skin-contacting surface; and a housing;

an ultrasonic oscillation circuit having an oscillation output that drives the ultrasonic vibrator;

a detection circuit that converts an impedance of the ultrasonic vibrator into an envelope voltage of an oscillation level and detects contact and non-contact of said application member with a skin by comparing the envelope voltage of the oscillation level with a reference voltage; and an oscillation control circuit that lowers a level of the oscillation output in response to a change from contact to non-contact of said application member with the skin, and increases the level of the oscillation output in response to a change from non-contact to contact of said application member with the skin, wherein said ultrasonic oscillation circuit, said detection circuit and said oscillator circuit are housed in said housing.

19. The ultrasonic cosmetic treatment device according to claim 18, further comprising:

a display that displays the status of contact or non-contact of the application member of said probe with the skin in accordance with the detection results obtained by said detection device, and changes from a status display of contact to a status display of non-contact after a predetermined delay time has elapsed since detection of a change from contact to non-contact of said application member with the skin by said detection circuit; and a display delay circuit that delays said change in said display by a predetermined delay time, said display thereby changing at the expiration of the predetermined delay time after said detection circuit detects a change in contact status of said ultrasonic vibrator probe with the skin.

20. The ultrasonic cosmetic treatment device according to claim 18, wherein the detection circuit changes the reference voltage when detecting the change of contact and non-contact of the application member with the skin.

* * * * *

UNITED STATES PATENT AND TRADEMARK OFFICE

CERTIFICATE OF CORRECTION

PATENT NO. : 6,176,840 B1
DATED : January 23, 2001
INVENTOR(S) : S. Nishimura et al.

It is certified that error appears in the above-identified patent and that said Letters Patent is hereby corrected as shown below:

Column 15,
Line 45, of the printed patent, "wherein" should be -- when --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*